United States Patent [19]

Kakitani

[11] Patent Number: 4,733,276

[45] Date of Patent: Mar. 22, 1988

[54] AUTOMATIC DENSITY CONTROL DEVICE FOR USE IN COPYING MACHINE

[75] Inventor: Yohtaro Kakitani, Yokosuka, Japan

[73] Assignee: Ricoh Company, Ltd., Tokyo, Japan

[21] Appl. No.: 12,491

[22] Filed: Feb. 9, 1987

[30] Foreign Application Priority Data

Feb. 18, 1986 [JP] Japan ..... 61-033542

[51] Int. Cl.[4] ..... G03G 15/04; G03G 15/06

[52] U.S. Cl. ..... 355/14 E; 355/14 SH; 355/14 D

[58] Field of Search ..... 355/14 E, 14 DD, 14 R, 355/3 DD, 3 R, 3 SH, 14 SH

[56] References Cited

U.S. PATENT DOCUMENTS

| | | | |
|---|---|---|---|
| 4,352,553 | 10/1982 | Hirahara | 355/14 E |
| 4,544,258 | 10/1985 | Takano | 355/14 E |
| 4,589,767 | 5/1986 | Yanagi et al. | 355/45 |
| 4,627,712 | 12/1986 | Usami | 355/14 E |
| 4,684,239 | 8/1987 | Takayanagi et al. | 355/14 E |

*Primary Examiner*—R. L. Moses

*Attorney, Agent, or Firm*—Oblon, Fisher, Spivak, McCelland & Maier

[57] ABSTRACT

An automatic density control device in a copying machine combined with an automatic document feeder capable of feeding a document onto a document support table has a document density detector for detecting the density of a document placed on the document support table, a scanner means movable in a forward direction for exposure to the image of the document on the document support table and movable in a backward direction for enabling the document density detector means to read the density of the document on the document support table, a reference position detector for detecting when the scanner means reaches a reference position, and a controller for determining the density of the document from a document density signal from the document density detector means in a range prior to generation of a signal by the reference position detector means when the scanner means moves back to the reference position, for determining an amount of exposure or an image developing bias voltage based on the document density signal, and for producing an output indicative of the amount of exposure or the image developing bias voltage in response to a first signal from the reference position detector means after the document has been fed by the automatic document feeder.

1 Claim, 11 Drawing Figures

AUTOMATIC DENSITY CONTROL DEVICE FOR USE IN COPYING MACHINE

BACKGROUND OF THE INVENTION

1. Field of the Invention

The present invention relates to an automatic density control device for controlling the density of a copied image in a copying machine.

2. Description of the Prior Art

Automatic density control devices of different types are known for use in copying machines. In one type, the density of a document to be copied is read by a scanner to determine the density of a copy image before the document is actually duplicated. According to another principle, the density of a document is read while it is being copied to determine the density of a copy image.

With the former automatic density control device, the document density is read by the scanner after the document has been set in place, and a copying cycle is started after the copy image density has been determined. Since various steps are involved to determine the copy image density before the copying cycle is initiated, the rate of overall operation of the copying machine is relatively low especially where an automatic document feeder is employed to feed documents. The latter automatic density control device determines the copy image density by reading the document density during the copying operation. Therefore, the copy image density cannot be controlled by controlling the amount of light applied to the document, and the automatic density control device is relatively costly.

SUMMARY OF THE INVENTION

In view of the aforesaid drawbacks with the conventional automatic density control devices, it is an object of the present invention to provide an automatic density control device of a relatively low cost for controlling a copy image density at a relatively high speed.

According to the present invention, there is provided an automatic density control device in a copying machine combined with an automatic document feeder capable of feeding a document onto a document support table, comprising document density detector means for detecting the density of a document placed on the document support table, scanner means movable in a forward direction for exposure to the image of the document on the document support table and movable in a backward direction for enabling the document density detector means to read the density of the document on the document support table, reference position detector means for detecting when the scanner means reaches a reference position, and control means for determining the density of the document from a document density signal from the document density detector means in a range prior to generation of a signal by the reference position detector means when the scanner means moves back to the reference position, for determining an amount of exposure or an image developing bias voltage based on the document density signal, and for producing an output indicative of the amount of exposure or the image developing bias voltage in response to a first signal from the reference position detector means after the document has been fed by the automatic document feeder.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
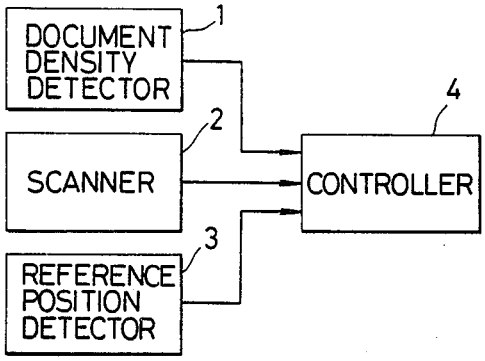
FIG. 1 is a block diagram of an automatic density control device according to the present invention.

An automatic density control device according to the present invention is particularly useful when employed in a copying machine combined with an automatic document feeder (ADF) capable of feeding a document onto a document support table for copying. As shown in FIG. 1, the automatic density control device essentially comprises a document density detector 1 for detecting the density of a document placed on the document support table, a scanner 2 movable in a forward direction for exposure to the image of the document on the document support table and movable in a backward direction for enabling the document density detector 1 to read the density of the document on the document support table, a reference position detector 3 for detecting when the scanner 2 reaches a reference position, and a controller 4 for determining the density of the document from a document density signal from the document density detector 1 in a range prior to generation of a signal by the reference position detector 3 when the scanner 2 moves back to the reference position, for determining an amount of exposure or an image developing bias voltage based on the document density signal, and for producing an output indicative of the amount of exposure or the image developing bias voltage in response to a first signal from the reference position detector 3 after the document has been fed by the automatic document feeder.

Figure 2:
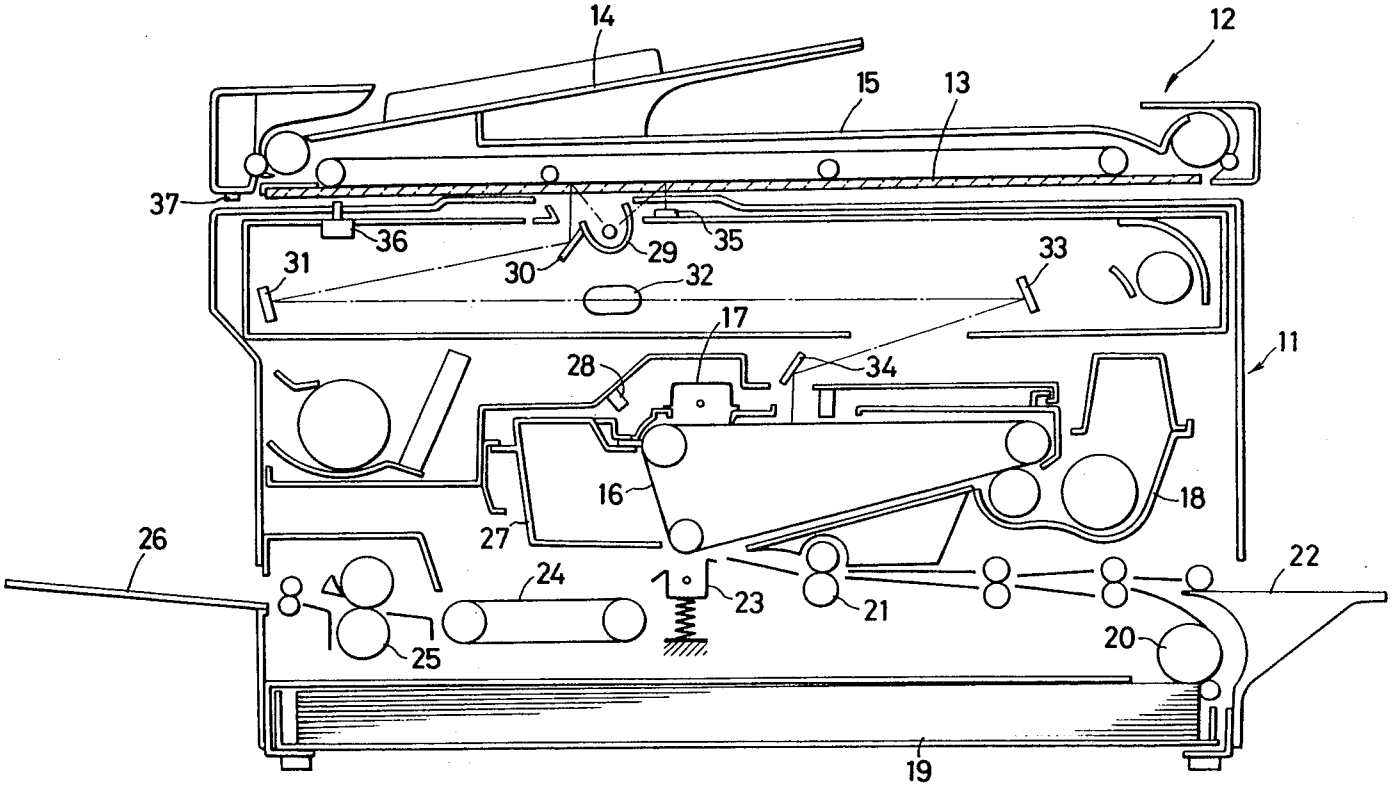
FIG. 2. is a vertical cross-sectional view of a copying machine incorporating the automatic density control device of the present invention.

The automatic density control device of the present invention will be described in greater detail. FIG. 2 shows a copying machine in which the principles of the present invention are incorporated. The copying machine has a copying machine mechanism 11 on which an automatic document feeder 12 is mounted. In a presser plate mode, a document is manually placed on a document support table 13 of the copying machine mechanism 11, and pressed down against the document support table 13 by the automatic document feeder 12 used as a document presser plate. In an ADF mode, the automatic document feeder 12 successively feeds documents stacked on a tray 14 onto the document support table 13, and successively discharges them onto a tray 15 after they have benn exposed to light.

In the copying machine mechanism 11, a photosensitive belt 16 is driven by a motor while it is being uniformly charged by a charger 17. Thereafter, the image of a document on the document support table 13 is exposed to the photosensitive belt 16 to form an electrostatic latent image thereon. The electrostatic latent image is then developed by an image developing device 18 into a visible image. An image transfer sheet of paper is delivered from a sheet cassette 19 by means of a feed roller 20 to register rollers 21. In a manual sheet insertion mode, an image transfer sheet that has manually been inserted over a manual insertion tray is fed to the register rollers 21. The register rollers 21 deliver the image transfer sheet in registry with the visible image on the photosensitive belt 16. The visible image is then transferred by a transfer charger 23 from the photosensitive belt 16 onto the image transfer sheet, which is then fed by a conveyor belt 24 into an image fixing device 25 in which the transferred image is fixed to the image transfer sheet. The image transfer sheet is thereafter discharged onto a tray 26.

After the image has been transferred from the photosensitive belt 16, the photosensitive belt 16 is cleaned by a cleaning device 27, and residual charges are erased from the photosensitive belt 16 by means of an eraser 28. The above cycle of operation is repeated to produce a desired number of copies from each document to be copied.

Figure 3:
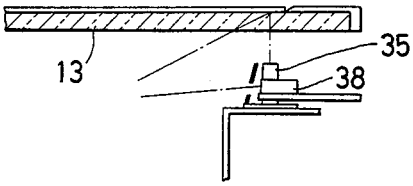
FIG. 3 is a front elevational view of a portion of the copying machine.
Figure 4:
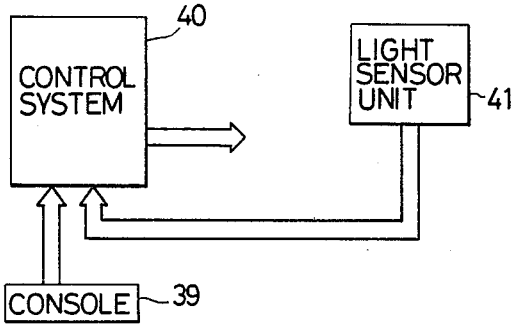
FIGS. 4 and 5 are block diagrams of an exposure control system in the copying machine.
Figure 5:
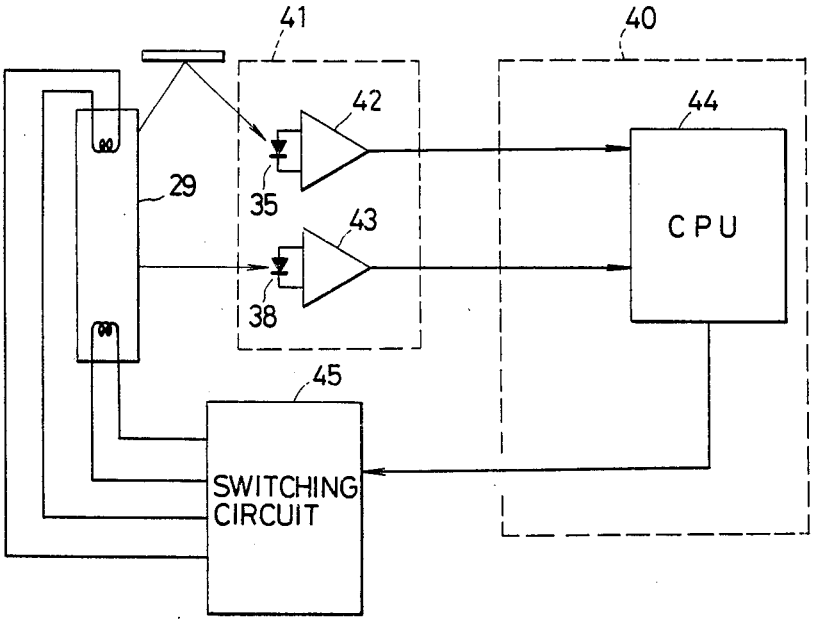

The scanner 2 of FIG. 1 includes the document support table 13 and the automatic document feeder 12. During movement in a forward direction of the document support table 13 and the automatic document feeder 12, the document on the document support table 13 is illuminated by light emitted from a light source 29, and a reflected light image from the document is focused via mirrors 30, 31 a lens 32, and mirrors 33, 34 onto the photosensitive drum 16 which is therefore exposed to the document image. During backward movement of the document support table 13 and the automatic document feeder 12 from a home position to a reference position, the document on the document support table 13 is also illuminated by light from the light source 29, and reflected light is applied to a document density sensor 35 (corresponding to the document density detector 1 in FIG. 1) which reads the document image. The reference position detector of FIG. 1 comprises a reference position sensor 36 which is turned on by being pressed by an actuator 37 integral with the document support table 13 when the latter reaches the reference position. A document sensor (not shown) detects a document on the tray 14. As shown in FIG. 3, a light control sensor 38 is positioned adjacent to the document density sensor 35 for directly detecting light from the light source 29. In FIG. 4, an operator's console 39 is operated by the operator to produce information indicative of whether automatic control of the density of a copy image is to be effected or not, and a signal representative of such information is applied from the operator's console 39 to a control system 40. As illustrated in FIG. 5, a light sensor unit 41 includes the document density sensor 35 and the light control sensor 38. Signals from these sensors 35, 38 are amplified by respective amplifiers 42, 43, output signals of which are then applied to a microcomputer or central processing unit (CPU) 44 (corresponding to the controller 4 in FIG. 1) in the control system 40. The light source 29 is driven by a switching circuit 45. The CPU 44 determines an amount of exposure in response to the document density signal from the document density sensor 35 based on the density information signal from the operator's console 35, and controls the switching circuit 45 based on the determined amount of exposure.

Figure 6:
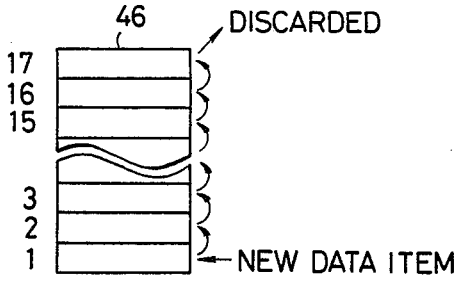
FIG. 6 is a schematic view of buffers in the copying machine.
Figure 7:
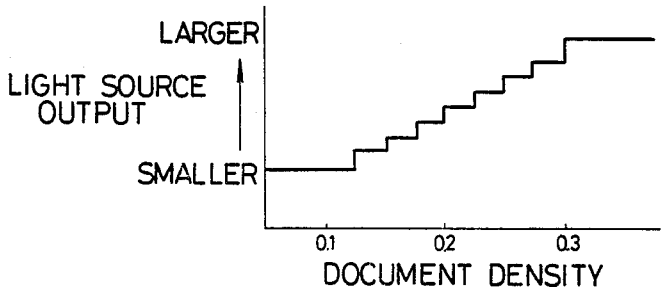
FIG. 7 is a graph showing a document density vs. light source output, curve.

The document support table 13 moves back and forth between the reference position and a predetermined reversal position, and is normally located in a central stop position between the reference position and the reversal position. When a copy starting key is depressed, a copy starting signal is issued by the copy starting key to enable the scanner to move the document support table 13 from the central stop position to the reference position (in the forward direction) and to energize the light source 29 so that the document density sensor 35 can read the document density. At the same time, the CPU 44 starts sampling a document density signal from the document density sensor 35. The document density signal is sampled every 24 ms (at an interval of 5.52 mm) with light being emitted from the light source 29 in the amount of a notch or graduation "3". Sampled data items are successively stored into 17 buffers 46 (FIG. 6). When the buffers 46 are full, the oldest data item is discarded to store the latest 17 data items in the buffers 46. When the reference position sensor 36 is turned on thereafter, the CPU 44 finishes the sampling process in response to a signal from the reference position sensor 36. The newest data item in the buffers 46 is discarded since it is a data item corresponding to the leading end of the document or an area other than the document. The remaining data items in the buffers 46 are regarded as effective, and the maximum data item is found and regarded as a data item representative of the background region of the document. The CPU 44 determines the amount of light emitted from the light source 29 from the maximum data item thus found, and controls the switching circuit 45 based on the determined amount of light and a signal from the light control sensor 38 for controlling the amount of light from the light source 29 at the determined amount of light. The CPU 44 effects the above light control during reciprocating movement of the document support table 13 (during exposure). When a succession of copies are produced from one document, the above data item of the determined amount of light is also used to carry out the light control for the light source. The amount of light emitted from the light source 29 is determined by the CPU 44 in order to meet the relationship between itself and the document density as shown in FIG. 7. Stated otherwise, as the document density is higher, the amount of light emitted from the light source is increased, and as the document density is lower, the amount of emitted light is reduced. This light control keeps the density of the copy image at a constant level irrespective of the document density.

Figure 8:
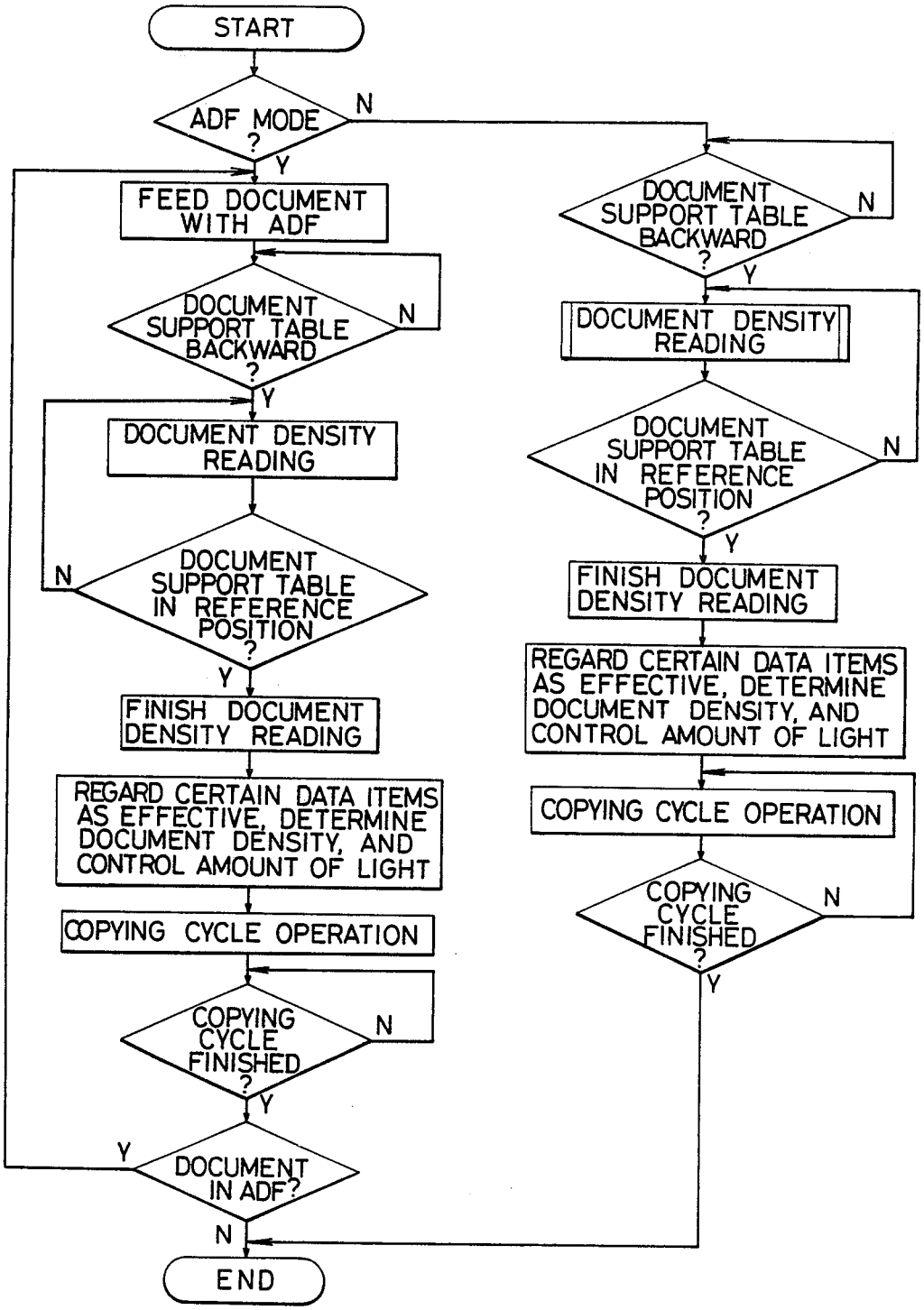
FIG. 8 is a flowchart of an operation sequence of a central processing unit (CPU) in the exposure control system.
Figure 9:
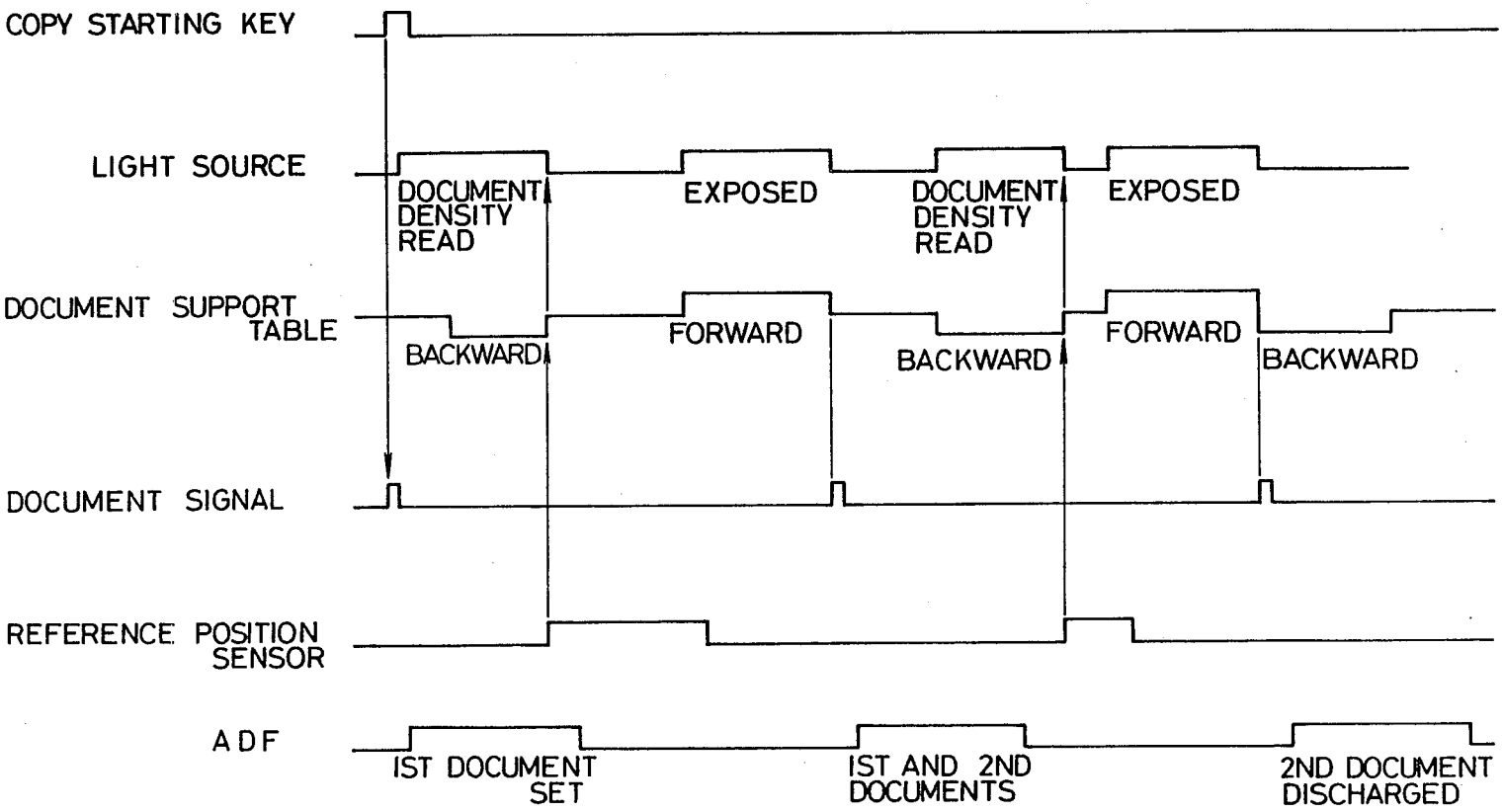
FIG. 9 is a timing chart of operation of the copying machine.

FIG. 8 shows an operation sequence of the CPU 44, and FIG. 9 shows a timing chart of operation of the copying machine.

Figure 10:
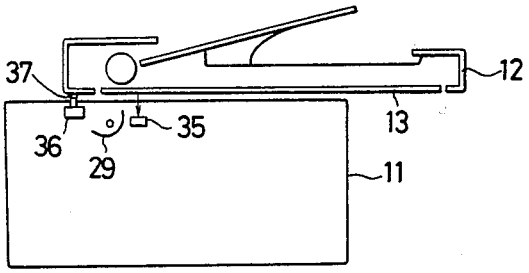
FIGS. 10 and 11 are cross-sectional views illustrating different operating positions of the copying machine.
Figure 11:
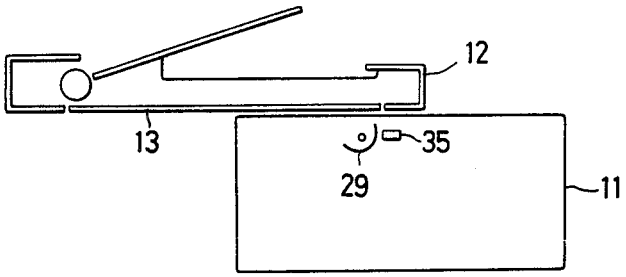

When the operator sets a document stack on the tray 14 and depresses a copy starting key, the CPU 44 operates in response to a signal from the copy starting key as follows: The CPU 44 is responsive to a signal from the document sensor for selecting the ADF mode to cause the automatic document feeder 12 to feed the uppermost document from the document stack on the tray 14 onto the document support table 13. Then, the CPU 44 moves the document support table 13 from the central stop position back to the reference position. During such backward movement of the document support table 13, the document is illuminated with light emitted from the light source 29 in the amount of a notch "3". The CPU 44 reads in a document density signal from the document density sensor 35, samples the document density signal, and stores sampled data items into the buffers 46. Upon arrival of the document support table 13 at the reference position, a signal is generated by the reference position sensor 36 and applied to the CPU 44 to finish the reading of the document density. The CPU 44 then regards the 8th through 17th document density data items stored in the buffers 46 as effective, determines the maximum data item thereof to be representative of the document density, and controls the amount of light emitted from the ligth source 29 at an amount of light (1) according to the document density. The CPU 44 enables the copying machine mechanism 11 to repeat a copying cycle until a desired number of copies are produced, during which time the CPU 44 refers to a signal from the light control sensor 38 to control the switching circuit 45 so as to equalize the amount of light from the light source 29 to the determined amount of light (1). At this time, the document support table 13 and the automatic document feeder 12 are repeatedly moved back and forth between the reference position and the reversal position, and the photosensitive belt 16 is exposed to the document image during the forward movement of the document support table 13 and the automatic document feeder 12. Upon completion of the copying cycles and arrival of the document support table 13 at the reversal position, the CPU 44 checks a signal from the document sensor to see if there is any document left on the tray 14. If no document is left on the tray 14, then the CPU 44 moves the document support table 13 back to the central stop position, and controls the automatic document feeder 12 to discharge the document on the document support table 13 onto the tray 15, thus completing the copying process. If a document remains on the tray 14, then the CPU 44 enables the automatic document feeder 12 to feed the document as the document support table 13 reaches the reversal position, and to replace the document on the document support table 13 with the next document. After the next document has reached the effective detection range of the document density sensor 35, the document support table 13 and the automatic document feeder 12 are moved from the reversal position shown in FIG. 11 back to the reference position shown in FIG. 10. The CPU 44 then energizes the light source 29 to illuminate the document with light in the amount of a notch "3", samples a document density signal from the document density sensor 35, and stores sampled data items into the buffers 46. When the document support table 13 returns to the reference position, the CPU 44 finishes the reading of the document density in response to a signal from the reference position sensor 36, finds the document density in the same manner as described above based on the data items stored in the buffers 46, and controls the amount of light from the light source 29 at an amount of light (2) according to the document density. The CPU 44 enables the copying machine mechanism 11 to repeat a copying cycle until a desired number of copies are produced, during which time the CPU 44 refers to a signal from the light control sensor 38 to control the switching circuit 45 so as to equalize the amount of light from the light source 29 to the determined amount of light (2). The above operation is repeated until no document is left on the document support table 13, whereupon the document support table 13 is moved back to the central stop position. The automatic document feeder 12 is controlled by the CPU 44 to discharge the document from the document support table 13 onto the tray 15, thus putting an end to the copying process.

When the operator sets a document on the document support table 13 and depresses a copy starting key, the CPU 44 operates in response to a signal from the copy starting key as follows: Since no signal is issued by the document sensor, the CPU 44 selects the pressure plate mode to cause the document support table 13 to be moved from the central stop position back to the reference position. Simultaneously, the document is illuminated with light emitted from the light source 29 in the amount of a notch "3". The CPU 44 reads in a document density signal from the document density sensor 35, samples the document density signal, and stores sampled data items into the buffers 46. Upon arrival of the document support table 13 at the reference position, a signal is generated by the reference position sensor 36 and applied to the CPU 44 to finish the reading of the document density. The CPU 44 then regards the 8th through 17th document density data items stored in the buffers 46 as effective, determines the maximum data item thereof to be representative of the document density, and controls the amount of light emitted from the ligth source 29 at an amount of light (3) according to the document density. Then, the CPU 44 enables the copying machine mechanism 11 to repeat a copying cycle until a desired number of copies are produced, during which time the CPU 44 refers to a signal from the light control sensor 38 to control the switching circuit 45 so as to equalize the amount of light from the light source 29 to the determined amount of light (3). When the desired copying cycles are finished, the document support table 13 is moved back to the central stop position and the copying process is completed.

While in the above embodiment the density of a copy image is controlled by controlling the amount of exposure, the copy image density may be controlled by controlling an image developing bias voltage.

With the arrangement of the present invention, each time a document is fed by the automatic document feeder, the density of a document is read upon backward movement of the scanner for determining an amount of exposure or an image developing bias voltage. Therefore, the rate of overall operation of the copying machine is prevented from being lowered. It is possible to control the density of a copy image by controlling the amount of exposure.

Although a certain preferred embodiment has been shown and described, it should be understood that many changes and modifications may be made therein without departing from the scope of the appended claim.

What is claimed is:

1. An automatic density control device in a copying machine combined with an automatic document feeder capable of feeding a document onto a document support table, comprising:

document density detector means for detecting the density of a document placed on the document support table;

scanner means movable in a forward direction for exposure to the image of the document on the document support table and movable in a backward direction for enabling said document density detector means to read the density of the document on the document support table;

reference position detector means for detecting when said scanner means reaches a reference position; and control means for determining the density of the document from a document density signal from said document density detector means in a range prior to generation of a signal by said reference position detector means when said scanner means moves back to the reference position, for determining an amount of exposure or an image developing bias voltage based on the document density signal, and for producing an output indicative of the amount of exposure or the image developing bias voltage in response to a first signal from said reference position detector means after the document has been fed by the automatic document feeder.

* * * * *